US010233755B2

(12) United States Patent
Liu et al.

(10) Patent No.: US 10,233,755 B2
(45) Date of Patent: Mar. 19, 2019

(54) DRILLING AND BURSTING HEADING MACHINE

(71) Applicant: China University of Mining and Technology, Jiangsu (CN)

(72) Inventors: Songyong Liu, Jiangsu (CN); Zhencai Zhu, Jiangsu (CN); Changlong Du, Jiangsu (CN); Hongxiang Jiang, Jiangsu (CN); Wei Li, Jiangsu (CN); Gang Shen, Jiangsu (CN); Yuxing Peng, Jiangsu (CN); Hongsheng Li, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 15/741,192

(22) PCT Filed: Aug. 11, 2016

(86) PCT No.: PCT/CN2016/094597

§ 371 (c)(1),
(2) Date: Dec. 29, 2017

(87) PCT Pub. No.: WO2017/156970

PCT Pub. Date: Sep. 21, 2017

(65) Prior Publication Data

US 2018/0195388 A1 Jul. 12, 2018

(30) Foreign Application Priority Data

Mar. 14, 2016 (CN) ..... 2016 1 0142395

(51) Int. Cl.
*E21C 25/06* (2006.01)
*E21D 9/10* (2006.01)
(Continued)

(52) U.S. Cl.
CPC ..... *E21D 9/10* (2013.01); *E21C 25/66* (2013.01); *E21C 27/22* (2013.01); *E21C 27/28* (2013.01);
(Continued)

(58) Field of Classification Search
CPC ..... E21C 25/06; E21D 20/00
See application file for complete search history.

(56) References Cited

U.S. PATENT DOCUMENTS 7,316,456 B2 * 1/2008 Walker ..... E21C 27/24 299/33

FOREIGN PATENT DOCUMENTS

CN 201215012 Y * 4/2009
CN 102261250 A 11/2011
(Continued)

OTHER PUBLICATIONS

International Search Report by the State Intellectual Property Office of the P.R. China for PCT/CN2016/094597 dated Dec. 21, 2016, 3 pp.

*Primary Examiner* — Sunil Singh
(74) *Attorney, Agent, or Firm* — Edwin S. Flores; Chalker Flores, LLP

(57) ABSTRACT

A drilling and bursting heading machine, comprising a drilling and bursting device (1), an angle control device, a forward-backward telescopic device and a cantilever type heading machine (2), wherein the drilling and bursting device (1) is mounted on a forward-backward moving component of the forward-backward telescopic device by means of the angle control device, and the forward-backward telescopic device is mounted on the cantilever type heading machine (2); the drilling and bursting device (1) comprises a fixing support (1-20), as well as a rock drill component and a bursting component fixedly mounted on
(Continued)

the fixing support (1-20) respectively; the angle control device comprises a mounting base (1-15), an auxiliary rotary hydraulic motor (1-14), an adjustment hydraulic cylinder (1-13) and a main rotary hydraulic motor (1-12); and when the forward-backward moving component of the forward-backward telescopic device completely extends out, the distance from a front end of the drilling and bursting device (1) to a working plane is shorter than the distance from a front end of a cutting head of the cantilever type heading machine (2) to the working plane. The drilling and bursting heading machine has a compact structure and is able to implement quick drilling and bursting on a hard rock stratum having a rock hardness f greater than 10 without increasing the energy consumption, so that the heading efficiency is improved and potential safety risks are reduced.

8 Claims, 4 Drawing Sheets

(51) Int. Cl.
*E21C 25/66* (2006.01)
*E21C 27/22* (2006.01)
*E21C 27/28* (2006.01)
*E21D 20/00* (2006.01)

(52) U.S. Cl.
CPC ..... *E21D 9/1006* (2013.01); *E21D 9/106* (2013.01); *E21D 9/1026* (2013.01); *E21C 25/06* (2013.01); *E21D 20/00* (2013.01)

(56) References Cited

FOREIGN PATENT DOCUMENTS

| | | | | |
|---|---|---|---|---|
| CN | 202228075 | U | * | 5/2012 |
| CN | 202690045 | U | * | 1/2013 |
| CN | 202991028 | U | * | 6/2013 |
| CN | 103233746 | A | | 8/2013 |
| CN | 204140082 | U | * | 2/2015 |
| CN | 204266919 | U | | 4/2015 |
| CN | 104612586 | A | | 5/2015 |
| CN | 105370294 | A | | 3/2016 |
| JP | 2008127848 | A | | 6/2008 |
| WO | WO 92/05339 | | * | 4/1992 |

* cited by examiner

DRILLING AND BURSTING HEADING MACHINE

CROSS-REFERENCE TO RELATED APPLICATIONS

This application is the National Stage of International Application No. PCT/CN2016/094597, filed on Aug. 11, 2016 claiming the priority of CN 201610142395.8, filed on Mar. 14, 2016, the contents of which is incorporated by reference herein.

FIELD OF THE INVENTION

The present invention relates to a heading machine, specifically to a drilling and bursting heading machine applicable to drilling and heading of a hard rock roadway having a hardness f greater than 10, and belongs to the technical field of heading machines.

BACKGROUND OF THE INVENTION

Heading machines are machines used for drilling straight underground roadways, and are divided into open heading machines and shield heading machines. A heading machine usually includes a traveling mechanism, a working mechanism, a loading and transporting mechanism and a transfer mechanism. With advancing of the traveling mechanism, a cutting head in the working mechanism continually crushes rock, and the crushed rock is carried away, so the heading machine has the advantages of high safety, high efficiency, good roadway forming quality and the like. Particularly, a cantilever type heading machine integrates the functions of cutting, loading and transporting, traveling, operation and the like, and is mainly used for cutting underground rock, coal or half coal rock roadways having cross sections in any shapes.

Drilling and blasting rock-breaking heading will still be a main method for tunneling of whole hard rock roadways within a very long period of time in China at present, heavy cantilever type heading machines used for heading of large-section rock roadways are under test in China, and whole rock roadway heavy cantilever type heading machines which are high in cutting power, high in cutting efficiency and stable in operation and have good dedusting systems will represent the development direction of a rock roadway heading technology in the future. The cantilever type heading machines have been greatly developed in whole rock roadways and half coal rock roadways having relatively low rock hardness f<10, and combined operating lines (also referred to as coal roadway comprehensive mechanized heading) of the cantilever type heading machines and single anchor rod drillers have gradually become a major means among efficient coal roadway heading means in China. However, the hardness of rock strata is usually an indefinite value, i.e., the rock hardness in different areas is not necessarily same, and the working condition is quite severe; when the rock hardness f is greater than 10, the cantilever type heading machine is extremely low in efficiency and its energy consumption is increased, and cutting teeth drop seriously and even cannot implement heading; the heading machine is usually retracted to a safe distance, and then drilling and blasting rock breaking and heading are implemented, so that the heading efficiency is relatively low, and the blasting operation has great safety hazard; therefore, high-hardness rock roadway heading has become a bottleneck of mechanized development of the heading machines in China.

SUMMARY OF THE INVENTION

In view of the above problems, the present invention provides a drilling and bursting heading machine, which has a compact structure and is able to implement quick drilling and bursting on a hard rock stratum having a rock hardness f greater than 10 without increasing the energy consumption, so that the heading efficiency is improved and potential safety risks are reduced.

In order to achieve the above object, the drilling and bursting heading machine includes a drilling and bursting device, an angle control device, a forward-backward telescopic device and a cantilever type heading machine, wherein the drilling and bursting device is mounted on a forward-backward moving component of the forward-backward telescopic device by means of the angle control device, and the forward-backward telescopic device is mounted on the cantilever type heading machine;

the drilling and bursting device includes a fixing support, a rock drill component and a bursting component, wherein the rock drill component and the bursting component are fixedly mounted on the fixing support respectively;

the rock drill component includes a connecting base I, a slide rail I, a positioning guide plate I, a telescopic drive mechanism, a rock drill, a drill rod and a slide block I; the slide rail I is arranged in the forward-backward direction via the connecting base I and fixedly mounted on the fixing support; the positioning guide plate I is erected at a front end of the slide rail I, and provided with a guiding hole matched with the drill rod in size; the drill rod penetrates through the guiding hole of the positioning guide plate I and is erected on the positioning guide plate I, and is mounted on the rock drill in a manner of facing forward; the rock drill is erected on the slide rail I via the slide block I fixedly mounted and connected to the rock drill and matched with the slide rail I; the telescopic drive mechanism is mounted on the slide rail I and connected with the rock drill;

the bursting component includes a connecting base II, a slide rail II, a positioning guide plate II, a telescopic drive mechanism, a slide block II and a bursting device; the slide rail II is arranged in the forward-backward direction via the connecting base II and fixedly mounted on the fixing support; the positioning guide plate II is erected at a front end of the slide rail II, and provided with a guiding hole matched with the outer diameter of a wedge jacking block of the bursting device; the wedge jacking block of the bursting device penetrates through the positioning hole of the positioning guide plate II and is erected on the positioning guide plate II, and is mounted on the bursting device in a manner of facing forward; the bursting device is erected on the slide rail II via the slide block II fixedly mounted and connected to the bursting device and matched with the slide rail II; the telescopic drive mechanism is mounted on the slide rail II and connected with the bursting device;

the angle control device includes a mounting base, an auxiliary rotary hydraulic motor, an adjustment hydraulic cylinder and a main rotary hydraulic motor; a top end of the mounting base is connected with the bottom of the fixing support, and a bottom end of the mounting base is fixedly connected with an output shaft of the auxiliary rotary hydraulic motor; one end of a shell of the auxiliary rotary hydraulic motor is articulated with one end of a shell of the main rotary hydraulic motor, and the other end of the shell of the auxiliary rotary hydraulic motor is connected with the other end of the shell of the main rotary hydraulic motor via the adjustment hydraulic cylinder;

an output shaft of the main rotary hydraulic motor is fixedly connected with the forward-backward moving component of the forward-backward telescopic device; when the forward-backward moving component of the forward-backward telescopic device completely extends out, the distance from a front end of the drilling and bursting device to a working plane is shorter than the distance from a front end of a cutting head of the cantilever type heading machine to the working plane.

As a preferred solution of the present invention, two sets of drilling and bursting devices, angle control devices and forward-backward telescopic devices are provided and symmetrically arranged on two sides of the rear of the cutting part of the cantilever type heading machine and on a supporting plate above the traveling part of the cantilever type heading machine.

As a preferred solution of the present invention, the forward-backward telescopic device is of a gear-rack structure, a gear is arranged in the forward-backward moving component and driven by a hydraulic motor, and a rack is mounted on the cantilever type heading machine.

As a further improved solution of the present invention, the forward-backward telescopic device is of a three-level telescopic structure, and includes a lower forward-backward telescopic device, a middle forward-backward telescopic device and an upper forward-backward telescopic device;

the lower forward-backward telescopic device includes a lower supporting rail, a lower guiding rack, a lower forward-backward moving component, a lower hydraulic drive motor and a lower drive gear, wherein the lower supporting rail is arranged in the forward-backward direction and fixedly mounted on the supporting plate, a limiting mechanism is arranged at each of two ends of the lower supporting rail, the lower guiding rack is fixedly mounted on the lower supporting rail, the lower drive gear is arranged in the lower forward-backward moving component and coaxially connected with an output shaft of the lower hydraulic drive motor mounted on the lower forward-backward moving component, the lower forward-backward moving component is erected on the lower supporting rail in a clamping fit manner, and the lower drive gear is engaged with the lower guiding rack;

the middle forward-backward telescopic device includes a middle supporting rail, a middle guiding rack, a middle forward-backward moving component, a middle hydraulic drive motor and a middle drive gear, wherein the middle supporting rail is arranged in the forward-backward direction and has a rear end mounted at a front end of the lower forward-backward moving component, a limiting mechanism is arranged at each of two ends of the middle supporting rail, the middle guiding rack is fixedly mounted on the middle supporting rail, the middle drive gear is arranged in the middle forward-backward moving component and coaxially connected with an output shaft of the middle hydraulic drive motor mounted on the middle forward-backward moving component, the middle forward-backward moving component is erected on the middle supporting rail in a clamping fit manner, and the middle drive gear is engaged with the middle guiding rack; the output shaft of the main rotary hydraulic motor is fixedly connected with the front of the middle forward-backward moving component;

the upper forward-backward telescopic device includes an upper supporting rail, an upper guiding rack, an upper hydraulic drive motor and an upper drive gear, wherein the upper supporting rail is fixedly mounted on a lower end face of the fixing support, a limiting mechanism is arranged at each of two ends of the upper supporting rail, the upper guiding rack is fixedly mounted on the upper supporting rail, the upper drive gear is arranged in the mounting base and coaxially connected with an output shaft of the upper hydraulic drive motor mounted on the mounting base, the mounting base is connected with the fixing support via the upper supporting rail clamped and matched with the mounting base, and the upper drive gear is engaged with the upper guiding rack.

As a further improved solution of the present invention, a rear end of the middle supporting rail is articulated to an upper part of the front end of the lower forward-backward moving component, a pitch control hydraulic cylinder articulated with the lower forward-backward moving component is arranged at a lower part of the front end of the lower forward-backward moving component, and the other end of the pitch control hydraulic cylinder is articulated with the bottom of the middle supporting rail.

As a further improved solution of the present invention, one end of the pitch control hydraulic cylinder and the rear end of the middle supporting rail are respectively articulated to the lower part and upper part of the front end of the lower forward-backward moving component via cross connectors, two pitch control hydraulic cylinders are provided, the two pitch control hydraulic cylinders are arranged side by side at the same horizontal position, a front end of the cross connector is horizontally articulated with the pitch control hydraulic cylinder or the rear end of the middle supporting rail, and a rear end of the cross connector is vertically articulated with the front end of the lower forward-backward moving component; the other ends of the two pitch control hydraulic cylinders are respectively articulated side by side with the same horizontal position of the bottom of the middle supporting rail via spherical hinges.

As an embodiment of the present invention, the telescopic drive mechanisms of the rock drill component and the bursting component of the drilling and bursting device are of chain drive structures, the telescopic drive mechanism of the rock drill component includes a chain drive assembly I and a rock drill moving drive hydraulic motor, and the telescopic drive mechanism of the bursting component includes a chain drive assembly II and a bursting device moving drive hydraulic motor; both the chain drive assembly I and the chain drive assembly II include a closed drive chain and a chain wheel, the closed drive chain of the chain drive assembly I is erected on the slide rail I via the chain wheel and fixedly connected with the slide block I, the rock drill moving drive hydraulic motor is mounted on the slide rail I, and an output shaft of the rock drill moving drive hydraulic motor is coaxially connected with the chain wheel; the closed drive chain of the chain drive assembly II is erected on the slide rail II via the chain wheel and fixedly connected with the slide rail II, the bursting device moving drive hydraulic motor is mounted on the slide rail II, and an output shaft of the bursting device moving drive hydraulic motor is coaxially connected with the chain wheel.

As a further improved solution of the present invention, the radius of gyration from the center of the drill rod of the rock drill component to the center of the output shaft of the main rotary hydraulic motor is matched with the radius of gyration from the center of the wedge jacking block of the bursting device to the center of the output shaft of the main rotary hydraulic motor.

Compared with the prior art, the drilling and bursting heading machine is provided with a drilling and bursting device including a rock drill component and a bursting component, the rock drill component with high drilling efficiency is organically combined with the bursting component capable of effectively blasting rock, the angle control device and the forward-backward telescopic device are mounted on the cantilever type heading machine with low heading capability and high cutting efficiency, in the presence of a hard rock stratum, the cross section of a roadway is drilled by the rock drill component under the working plane to form a free surface, then the middle part and upper part of the working plane are drilled and burst by using the bursting component to reduce the fracture strength of rock, and the working plane of the roadway is developed and headed by the cutting part of the heading machine, so that mechanized operation on the hard rock stratum is realized, and the problems of exploitation failure, low efficiency and serious damage of cutting teeth when the heading machine exploits hard rock are avoided; owning to the angle control device, the drilling and bursting device can realize six-degree-of-freedom motion, and can meet the requirements for drilling and bursting of various angles, positions and postures; two sets of drilling and bursting devices symmetrically arranged on the same cantilever type heading machine can work simultaneously, thereby greatly improving the operation range and the heading efficiency, realizing the functions of two rock drills, two bursting devices and one cantilever type heading machine, and greatly reducing the roadway development cost; and the drilling and bursting heading machine is compact in structure and high in heading capability and heading efficiency, reduces the loss of parts, is flexible in posture adjustment of the drilling and bursting mechanism, can maximally meet the requirements for drilling and bursting during hard rock heading, and is particularly suitable for developing and heading rock roadways having the rock thickness f greater than 10.

Reference signs: 1—drilling and bursting device, 1-1—lower supporting rail, 1-2—lower guiding rack, 1-3—lower forward-backward moving component, 1-4—lower hydraulic drive motor, 1-5—lower drive gear, 1-6—cross connector, 1-7—pitch control hydraulic cylinder, 1-8—middle supporting rail, 1-9—middle forward-backward moving component, 1-10—middle hydraulic drive motor, 1-11—middle drive gear, 1-12—main rotary hydraulic motor, 1-13—adjustment hydraulic cylinder, 1-14—auxiliary rotary hydraulic motor, 1-15—mounting base, 1-16—upper drive gear, 1-17—upper hydraulic drive motor, 1-18—upper supporting rail, 1-19—upper guiding rack, 1-20—fixing support, 1-21—connecting base I, 1-22-1—slide rail I, 1-22-2—positioning guide plate I, 1-23—chain drive assembly I, 1-24-1—rock drill, 1-24-2—drill rod, 1-24-3—slide block I, 1-25—rock drill moving drive hydraulic motor, 1-26—connecting base II, 1-27-1—slide rail II, 1-27-2—positioning guide plate II, 1-28—bursting device moving drive hydraulic motor, 1-29—chain drive assembly II, 1-30-1—slide block II, 1-30-2—bursting device, 1-31—middle guiding rack, 2—cantilever type heading machine, 2-1—supporting plate.

DETAILED DESCRIPTION OF THE EMBODIMENTS

The present invention will be further described below in combination with the accompanying drawings (the heading direction of a cantilever type heading machine is used as the forward direction in the following description).

Figure 1:
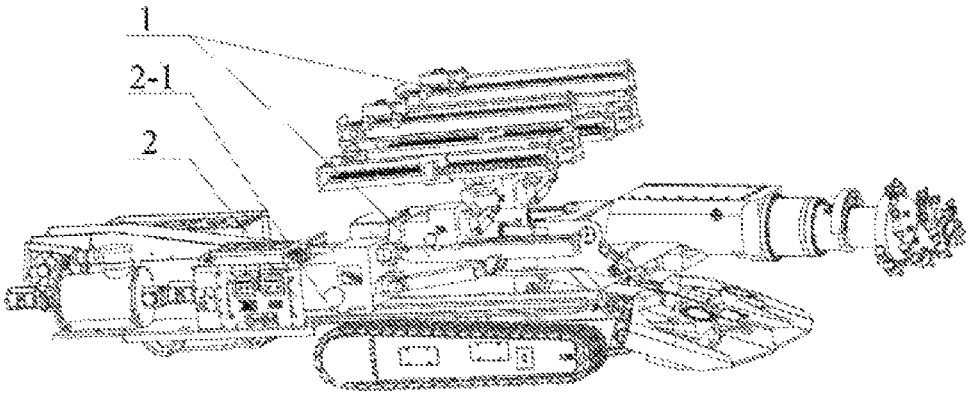
FIG. 1 is a three-dimensional structure diagram of a drilling and bursting device of the present invention in a completely retracted state.
Figure 2:
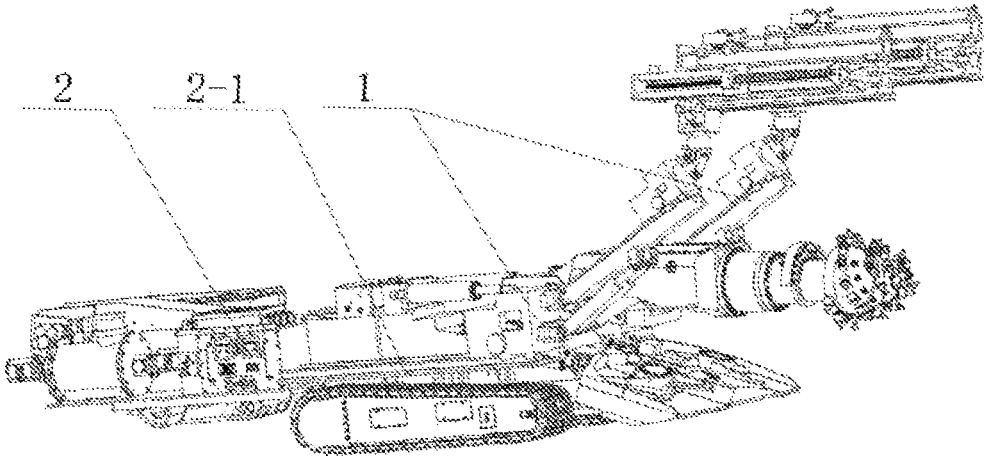
FIG. 2 is a three-dimensional structure diagram of the drilling and bursting device of the present invention in a completely unfolded state.
Figure 3:
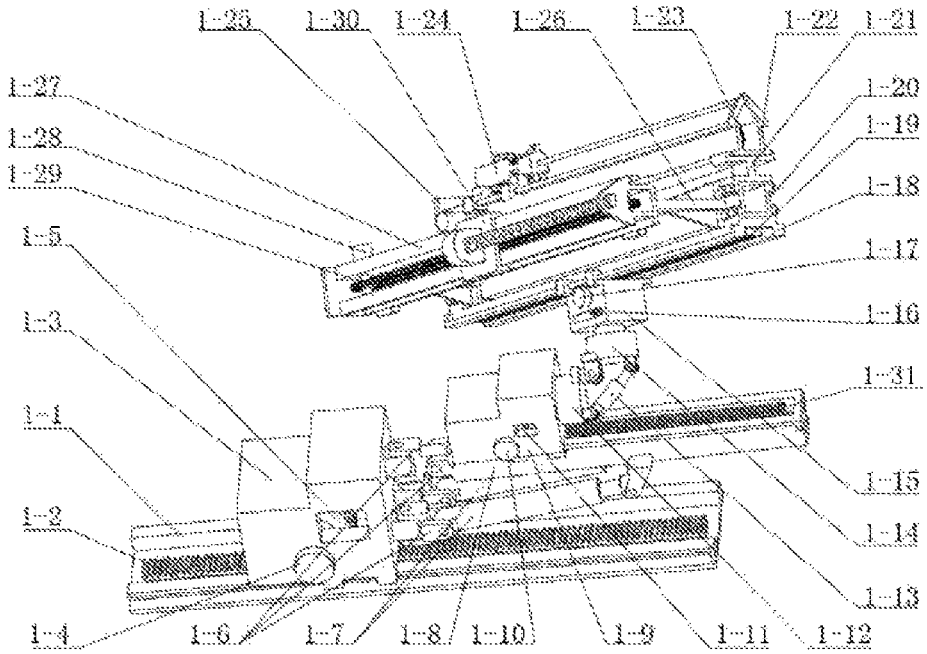
FIG. 3 is a three-dimensional structure diagram of the drilling and bursting device, an angle control device and a forward-backward telescopic device of the present invention.
Figure 4:
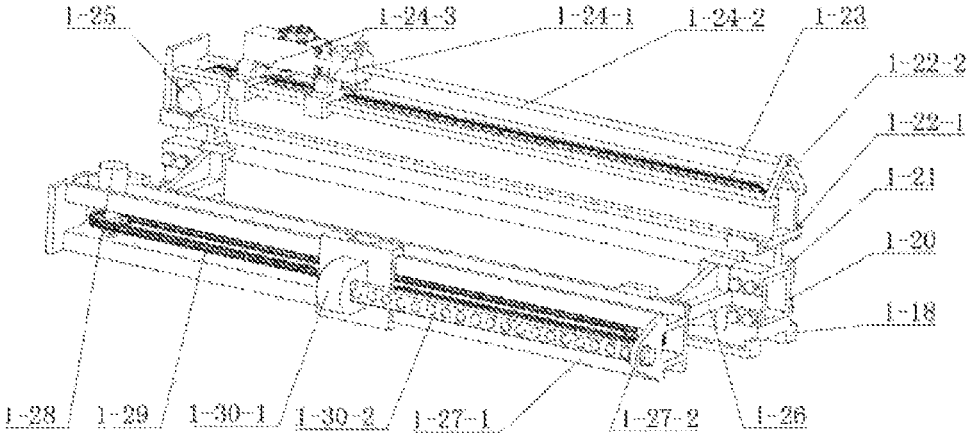
FIG. 4 is a three-dimensional structure diagram of the drilling and bursting device of the present invention.

As shown in FIG. 1, the drilling and bursting heading machine includes a drilling and bursting device 1, an angle control device, a forward-backward telescopic device and a cantilever type heading machine 2, wherein the drilling and bursting device 1 is mounted on a forward-backward moving component of the forward-backward telescopic device by means of the angle control device, and the forward-backward telescopic device is mounted on the cantilever type heading machine 2;

the drilling and bursting device 1 includes a fixing support 1-20, a rock drill component and a bursting component, wherein the rock drill component and the bursting component are fixedly mounted on the fixing support 1-20 respectively;

the rock drill component includes a connecting base I 1-21, a slide rail I 1-22-1, a positioning guide plate I 1-22-2, a telescopic drive mechanism, a rock drill 1-24-1, a drill rod 1-24-2 and a slide block I 1-24-3; the slide rail I 1-22-1 is arranged in the forward-backward direction via the connecting base I 1-21 and fixedly mounted on the fixing support 1-20; the positioning guide plate I 1-22-2 is erected at a front end of the slide rail I 1-22-1, and provided with a guiding hole matched with the drill rod 1-24-2 in size; the drill rod 1-24-2 penetrates through the guiding hole of the positioning guide plate I 1-22-2 and is erected on the positioning guide plate I 1-22-2, and is mounted on the rock drill 1-24-1 in a manner of facing forward; the rock drill 1-24-1 is erected on the slide rail I 1-22-1 via the slide block I 1-24-3 fixedly mounted and connected to the rock drill 1-24-1 and matched with the slide rail I 1-22-1; the telescopic drive mechanism is mounted on the slide rail I 1-22-1 and connected with the rock drill 1-24-1, and the rock drill 1-24-1 mounted with the drill rod 1-24-2 can move forward and backward on the slide rail I 1-22-1 by controlling extension and retraction of the telescopic drive mechanism;

the bursting component includes a connecting base II 1-26, a slide rail II 1-27-1, a positioning guide plate II 1-27-2, a telescopic drive mechanism, a slide block II 1-30-1 and a bursting device 1-30-2; the slide rail II 1-27-1 is arranged in the forward-backward direction via the connecting base II 1-26 and fixedly mounted on the fixing support 1-20; the positioning guide plate II 1-27-2 is erected at a front end of the slide rail II 1-27-1, and provided with a guiding hole matched with the outer diameter of a wedge jacking block of the bursting device 1-30-2; the wedge jacking block of the bursting device 1-30-2 penetrates through the positioning hole of the positioning guide plate II 1-27-2 and is erected on the positioning guide plate II 1-27-2, and is mounted on the bursting device 1-30-2 in a manner of facing forward; the bursting device 1-30-2 is erected on the slide rail II 1-27-1 via the slide block II 1-30-1 fixedly mounted and connected to the bursting device 1-30-2 and matched with the slide rail II 1-27-1; the telescopic drive mechanism is mounted on the slide rail II 1-27-1 and connected with the bursting device 1-30-2, and the bursting device 1-30-2 mounted with the wedge jacking block can move forward and backward on the slide rail II 1-27-1 by controlling extension and retraction of the telescopic drive mechanism.

The angle control device includes a mounting base 1-15, an auxiliary rotary hydraulic motor 1-14, an adjustment hydraulic cylinder 1-13 and a main rotary hydraulic motor 1-12; a top end of the mounting base 1-15 is connected with the bottom of the fixing support 1-20, and a bottom end of the mounting base 1-15 is fixedly connected with an output shaft of the auxiliary rotary hydraulic motor 1-14; one end of a shell of the auxiliary rotary hydraulic motor 1-14 is articulated with one end of a shell of the main rotary hydraulic motor 1-12, and the other end of the shell of the auxiliary rotary hydraulic motor 1-14 is connected with the other end of the shell of the main rotary hydraulic motor 1-12 via the adjustment hydraulic cylinder 1-13; an output shaft of the main rotary hydraulic motor 1-12 is fixedly connected with the forward-backward moving component of the forward-backward telescopic device; the whole drilling and bursting device 1 and auxiliary rotary hydraulic motor 1-14 can rotate along the axis of the output shaft of the main rotary hydraulic motor 1-12 by controlling rotation of the output shaft of the main rotary hydraulic motor 1-12, the drilling and bursting device 1 can rotate along the axis of the output shaft of the auxiliary rotary hydraulic motor 1-14 by controlling rotation of the output shaft of the auxiliary rotary hydraulic motor 1-14, and the included angle between the auxiliary rotary hydraulic motor 1-14 and the main rotary hydraulic motor 1-12 can be adjusted by controlling extension and retraction of the adjustment hydraulic cylinder 1-13.

When the forward-backward moving component of the forward-backward telescopic device completely extends out, the distance from a front end of the drilling and bursting device 1 to a hard rock stratum in the heading direction is shorter than the distance from a front end of a cutting head of the cantilever type heading machine 2 to the hard rock stratum in the heading direction, i.e., when the forward-backward telescopic device completely extends out of the drilling and bursting device 1 to carry out a drilling and bursting operation on the working plane of the hard rock stratum, the cutting head of the cantilever type heading machine 2 does not contact the working plane.

The drilling and bursting heading machine can control the forward-backward telescopic device to completely retract during normal heading so that the whole drilling and bursting device 1 and angle control device are located behind the cutting part of the cantilever type heading machine 2, and the cutting part can conveniently cut the rock stratum; in the presence of a hard rock stratum, the cutting part of the cantilever type heading machine 2 is controlled to drop, then the forward-backward telescopic device is controlled to completely extend out so that the drilling and bursting device 1 approaches the working plane, and the main rotary hydraulic motor 1-12, the auxiliary rotary hydraulic motor 1-14 and the adjustment hydraulic cylinder 1-13 are adjusted to realize six-degree-of-freedom motion of the drilling and bursting device 1 so as to meet the requirements for drilling and bursting of various angles, positions and postures; the position and posture of the drilling and bursting device 1 is reasonably adjusted during operation so that the rock drill component and the bursting component are perpendicular to a certain position of the working plane, and then the telescopic drive mechanisms of the rock drill component and the bursting component are controlled in sequence to realize cyclic operation of the rock drill component and the bursting component according to needs, namely drilling and then bursting; the cross section of the working plane is drilled by the rock drill component under the working plane to form a free surface, then the middle part and upper part of the working plane are drilled in sequence and burst by using the bursting component to reduce the fracture strength of rock, the forward-backward telescopic device is controlled to completely retract after drilling and bursting of the working plane so that the whole drilling and bursting device 1 and angle control device are located behind the cutting part of the cantilever type heading machine 2, and finally, the working plane is developed and headed by the cutting part of the cantilever type heading machine 2.

The drilling and bursting device 1 of the drilling and bursting heading machine can be matched with the cantilever type heading machines 2 of different models, i.e., by changing the height of the connecting base I 1-21, the radius of a group of holes drilled in the working plane by the rock drill component only when the main rotary hydraulic motor 1-12 rotates can adapt to the cantilever type heading machines 2 of the different types; and by setting the mounting angles of the connecting base I 1-21 and the connecting base II 1-26, the central angle of the front hole and the rear hole drilled in the working plane by the rock drill component only when the main rotary hydraulic motor 1-12 rotates can be changed, and the requirements for drilling and bursting of various angles, positions and postures are thus met.

The whole drilling and bursting device 1, angle control device and forward-backward telescopic device can be directly arranged at the rear upper part of the cutting part of the cantilever type heading machine 2, or two sets of them are symmetrically arranged on two sides of the rear of the cutting part of the cantilever type heading machine 2; in the latter case, the drilling and bursting range is larger, and the space occupied within a height range is smaller than the space occupied in the former case, and the forward-backward telescopic device in a completely retracted state does not interfere with the operation of the cutting part of the cantilever type heading machine 2, so the latter is preferred, i.e., as a preferred solution of the present invention, two sets of drilling and bursting devices 1, angle control devices and forward-backward telescopic devices are provided and symmetrically arranged on two sides of the rear of the cutting part of the cantilever type heading machine 2 and on a supporting plate 2-1 above the traveling part of the cantilever type heading machine 2.

The forward-backward telescopic device may be directly a hydraulic cylinder, or a gear-rack driven telescopic device having a pure mechanical structure, or a telescopic device having a screw jack structure, wherein in the first solution, additional mounting position and additional space needs to be considered for the long cylinder body, and a telescopic end rigid supporting mechanism is needed to relieve the radial stress and prevent damage when the hydraulic cylinder is directly adopted, so the structure is relatively complex; the second solution is relatively simple in structure and control, facilitates manufacturing, and is higher in extension and retraction speed than the third solution, so the second solution is preferred, that is, as a preferred solution of the present invention, the forward-backward telescopic device is of a gear-rack structure, a gear is arranged in the forward-backward moving component and driven by a hydraulic motor, and a rack is mounted on the cantilever type heading machine 2.

Since the underground construction condition is severe, if a single rack is arranged, the rack should be long enough in order to ensure enough extension length of the forward-backward telescopic device; the too long rack occupies much mounting space, so that the operation of the cutting part is liable to be disturbed while the structure is not compact; therefore, as a further improved solution of the present invention, the forward-backward telescopic device is of a three-level telescopic structure, and includes a lower forward-backward telescopic device, a middle forward-backward telescopic device and an upper forward-backward telescopic device;

the lower forward-backward telescopic device includes a lower supporting rail 1-1, a lower guiding rack 1-2, a lower forward-backward moving component 1-3, a lower hydraulic drive motor 1-4 and a lower drive gear 1-5, wherein the lower supporting rail 1-1 is arranged in the forward-backward direction and fixedly mounted on the supporting plate 2-1, a limiting mechanism is arranged at each of two ends of the lower supporting rail 1-1, the lower guiding rack 1-2 is fixedly mounted on the lower supporting rail 1-1, the lower drive gear 1-5 is arranged in the lower forward-backward moving component 1-3 and coaxially connected with an output shaft of the lower hydraulic drive motor 1-4 mounted on the lower forward-backward moving component 1-3, the lower forward-backward moving component 1-3 is erected on the lower supporting rail 1-1 in a clamping fit manner, and the lower drive gear 1-5 is engaged with the lower guiding rack 1-2; by positively and inversely driving the lower hydraulic drive motor 1-4, the lower forward-backward moving component 1-3 can move forward and backward on the lower supporting rail 1-1 to realize first-level extension and retraction;

the middle forward-backward telescopic device includes a middle supporting rail 1-8, a middle guiding rack 1-31, a middle forward-backward moving component 1-9, a middle hydraulic drive motor 1-10 and a middle drive gear 1-11, wherein the middle supporting rail 1-8 is arranged in the forward-backward direction and has a rear end mounted at a front end of the lower forward-backward moving component 1-3, a limiting mechanism is arranged at each of two ends of the middle supporting rail 1-8, the middle guiding rack 1-31 is fixedly mounted on the middle supporting rail 1-8, the middle drive gear 1-11 is arranged in the middle forward-backward moving component 1-9 and coaxially connected with an output shaft of the middle hydraulic drive motor 1-10 mounted on the middle forward-backward moving component 1-9, the middle forward-backward moving component 1-9 is erected on the middle supporting rail 1-8 in a clamping fit manner, and the middle drive gear 1-11 is engaged with the middle guiding rack 1-31; the output shaft of the main rotary hydraulic motor 1-12 is fixedly connected with the front of the middle forward-backward moving component 1-9; by positively and inversely driving the middle hydraulic drive motor 1-10, the middle forward-backward moving component 1-9 can move forward and backward on the middle supporting rail 1-8 to realize second-level extension and retraction;

the upper forward-backward telescopic device includes an upper supporting rail 1-18, an upper guiding rack 1-19, an upper hydraulic drive motor 1-17 and an upper drive gear 1-16, wherein the upper supporting rail 1-18 is fixedly mounted on a lower end face of the fixing support 1-20, a limiting mechanism is arranged at each of two ends of the upper supporting rail 1-18, the upper guiding rack 1-19 is fixedly mounted on the upper supporting rail 1-18, the upper drive gear 1-16 is arranged in the mounting base 1-15 and coaxially connected with an output shaft of the upper hydraulic drive motor 1-17 mounted on the mounting base 1-15, the mounting base 1-15 is connected with the fixing support 1-20 via the upper supporting rail 1-18 clamped and matched with the mounting base 1-15, and the upper drive gear 1-16 is engaged with the upper guiding rack 1-19; by positively and inversely driving the upper hydraulic drive motor 1-17, the fixing support 1-20 can move forward and backward relative to the mounting base 1-15 to realize third-level extension and retraction;

the forward-backward telescopic device having a compact three-level telescopic structure can realize a reduced mounting space, and is unlikely to interfere with the operation of the cutting part.

In order to increase the operation range of the drilling and bursting device 1, as a further improved solution of the present invention, a rear end of the middle supporting rail 1-8 is articulated to an upper part of the front end of the lower forward-backward moving component 1-3, a pitch control hydraulic cylinder 1-7 articulated with the lower forward-backward moving component 1-3 is arranged at a lower part of the front end of the lower forward-backward moving component 1-3, the other end of the pitch control hydraulic cylinder 1-7 is articulated with the bottom of the middle supporting rail 1-8, and the middle supporting rail 1-8 can rotate along an articulated shaft of the pitch control hydraulic cylinder 1-7 by controlling extension and retraction of the pitch control hydraulic cylinder 1-7, so that the drilling and bursting device 1 mounted on the middle supporting rail 1-8 realizes pitching, and the operation range is increased.

In order to further increase the operation range of the drilling and bursting device 1, as a further improved solution of the present invention, one end of the pitch control hydraulic cylinder 1-7 and the rear end of the middle supporting rail 1-8 are respectively articulated to the lower part and upper part of the front end of the lower forward-backward moving component 1-3 via cross connectors 1-6, two pitch control hydraulic cylinders 1-7 are provided, the two pitch control hydraulic cylinders 1-7 are arranged side by side at the same horizontal position, a front end of the cross connector 1-6 is horizontally articulated with the pitch control hydraulic cylinder 1-7 or the rear end of the middle supporting rail 1-8, and a rear end of the cross connector 1-6 is vertically articulated with the front end of the lower forward-backward moving component 1-3; the other ends of the two pitch control hydraulic cylinders 1-7 are respectively articulated side by side with the same horizontal position of the bottom of the middle supporting rail 1-8 via spherical hinges; by controlling synchronous extension and retraction of the same extension and retraction quantity of the two pitch control hydraulic cylinders 1-7, the drilling and bursting device 1 mounted on the middle supporting rail 1-8 can realize pitching; and by controlling different extension and retraction quantities of the two pitch control hydraulic cylinders 1-7, the drilling and bursting device 1 mounted on the middle supporting rail 1-8 can swing leftward and rightward, so that the operation range is further increased.

As an embodiment of the present invention, the telescopic drive mechanisms of the rock drill component and the bursting component of the drilling and bursting device 1 are of chain drive structures, the telescopic drive mechanism of the rock drill component includes a chain drive assembly I 1-23 and a rock drill moving drive hydraulic motor 1-25, and the telescopic drive mechanism of the bursting component includes a chain drive assembly II 1-29 and a bursting device moving drive hydraulic motor 1-28; both the chain drive assembly I 1-23 and the chain drive assembly II 1-29 include a closed drive chain and a chain wheel, the closed drive chain of the chain drive assembly I 1-23 is erected on the slide rail I 1-22-1 via the chain wheel and fixedly connected with the slide block I 1-24-3, the rock drill moving drive hydraulic motor 1-25 is mounted on the slide rail I 1-22-1, and an output shaft of the rock drill moving drive hydraulic motor 1-25 is coaxially connected with the chain wheel; the closed drive chain of the chain drive assembly II 1-29 is erected on the slide rail II 1-27-1 via the chain wheel and fixedly connected with the slide rail II 1-27-1, the bursting device moving drive hydraulic motor 1-28 is mounted on the slide rail II 1-27-1, and an output shaft of the bursting device moving drive hydraulic motor 1-28 is coaxially connected with the chain wheel; and by controlling the rock drill moving drive hydraulic motor 1-25 and the bursting device moving drive hydraulic motor 1-28 to rotate, the chain wheels can be driven to drive the closed drive chains so as to drive the rock drill 1-24-1 and the bursting device 1-30-2 to move forward and backward.

In order that the bursting component can be accurately positioned to burst the drilled hole after the rock drill component completes drilling, as a further improved solution of the present invention, the radius of gyration from the center of the drill rod 1-24-2 of the rock drill component to the center of the output shaft of the main rotary hydraulic motor 1-12 is matched with the radius of gyration from the center of the wedge jacking block of the bursting device 1-30-2 to the center of the output shaft of the main rotary hydraulic motor 1-12, the hole drilled by the rock drill component can be accurately concentrically positioned with the bursting hole of the bursting component by controlling rotation of the output shaft of the main rotary hydraulic motor 1-12, i.e., after the drill rod 1-24-2 of the rock drill component completes drilling and retracts, the wedge jacking block of the bursting device 1-30-2 of the bursting component is opposite to the drilled hole only by controlling the output shaft of the main rotary hydraulic motor 1-12 to rotate an appropriate angle, and the wedge jacking block of the bursting device 1-30-2 penetrates the drilled hole for bursting by controlling the telescopic drive mechanism of the bursting component.

The drilling and bursting heading machine is provided with a drilling and bursting device 1 including a rock drill component and a bursting component, the rock drill component with high drilling efficiency is organically combined with the bursting component capable of effectively bursting rock, the angle control device and the forward-backward telescopic device are mounted on the cantilever type heading machine 2 with low heading capability and high cutting efficiency, in the presence of a hard rock stratum, the cross section of a roadway is drilled by the rock drill component under the working plane to form a free surface, then the middle part and upper part of the working plane are drilled and burst by using the bursting component to reduce the fracture strength of rock, and the working plane of the roadway is developed and headed by the cutting part of the heading machine, so that mechanized operation on the hard rock stratum is realized, and the problems of exploitation failure, low efficiency and serious damage of cutting teeth when the heading machine exploits hard rock are avoided; owning to the angle control device, the drilling and bursting device 1 can realize six-degree-of-freedom motion, and can meet the requirements for drilling and bursting of various angles, positions and postures; two sets of drilling and bursting devices 1 symmetrically arranged on the same cantilever type heading machine 2 can work simultaneously, thereby greatly improving the operation range and the heading efficiency, realizing the functions of two rock drills, two bursting devices and a cantilever type heading machine, and greatly reducing the roadway development cost; and the drilling and bursting heading machine is compact in structure and high in heading capability and heading efficiency, reduces the loss of parts, is flexible in posture adjustment of the drilling and bursting mechanism, can maximally meet the requirements for drilling and bursting during hard rock heading, and is particularly suitable for developing and heading rock roadways having the rock thickness f greater than 10.

The invention claimed is:

1. A drilling and bursting heading machine, comprising a cantilever type heading machine (2), characterized by further comprising a drilling and bursting device (1), an angle control device and a forward-backward telescopic device, wherein the drilling and bursting device (1) is mounted on a forward-backward moving component of the forward-backward telescopic device by means of the angle control device, and the forward-backward telescopic device is mounted on the cantilever type heading machine (2);

the drilling and bursting device (1) comprises a fixing support (1-20), a rock drill component and a bursting component, wherein the rock drill component and the bursting component are fixedly mounted on the fixing support (1-20) respectively;

the rock drill component comprises a connecting base I (1-21), a slide rail I (1-22-1), a positioning guide plate I (1-22-2), a telescopic drive mechanism, a rock drill (1-24-1), a drill rod (1-24-2) and a slide block I (1-24-3); the slide rail I (1-22-1) is arranged in the forward-backward direction via the connecting base I (1-21) and fixedly mounted on the fixing support (1-20); the positioning guide plate I (1-22-2) is erected at a front end of the slide rail I (1-22-1), and provided with a guiding hole matched with the drill rod (1-24-2) in size; the drill rod (1-24-2) penetrates through the guiding hole of the positioning guide plate I (1-22-2) and is erected on the positioning guide plate I (1-22-2), and is mounted on the rock drill (1-24-1) in a manner of facing forward; the rock drill (1-24-1) is erected on the slide rail I (1-22-1) via the slide block I (1-24-3) fixedly mounted and connected to the rock drill (1-24-1) and matched with the slide rail I (1-22-1); the telescopic drive mechanism is mounted on the slide rail I (1-22-1) and connected with the rock drill (1-24-1);

the bursting component comprises a connecting base II (1-26), a slide rail II (1-27-1), a positioning guide plate II (1-27-2), a telescopic drive mechanism, a slide block II (1-30-1) and a bursting device (1-30-2); the slide rail II (1-27-1) is arranged in the forward-backward direction via the connecting base II (1-26) and fixedly mounted on the fixing support (1-20); the positioning guide plate II (1-27-2) is erected at a front end of the slide rail II (1-27-1), and provided with a guiding hole matched with the outer diameter of a wedge jacking block of the bursting device (1-30-2); the wedge jacking block of the bursting device (1-30-2) penetrates through the positioning hole of the positioning guide plate II (1-27-2) and is erected on the positioning guide plate II (1-27-2), and is mounted on the bursting device (1-30-2) in a manner of facing forward; the bursting device (1-30-2) is erected on the slide rail II (1-27-1) via the slide block II (1-30-1) fixedly mounted and connected to the bursting device (1-30-2) and matched with the slide rail II (1-27-1); the telescopic drive mechanism is mounted on the slide rail II (1-27-1) and connected with the bursting device (1-30-2);

the angle control device comprises a mounting base (1-15), an auxiliary rotary hydraulic motor (1-14), an adjustment hydraulic cylinder (1-13) and a main rotary hydraulic motor (1-12); a top end of the mounting base (1-15) is connected with the bottom of the fixing support (1-20), and a bottom end of the mounting base (1-15) is fixedly connected with an output shaft of the auxiliary rotary hydraulic motor (1-14); one end of a shell of the auxiliary rotary hydraulic motor (1-14) is articulated with one end of a shell of the main rotary hydraulic motor (1-12), and the other end of the shell of the auxiliary rotary hydraulic motor (1-14) is connected with the other end of the shell of the main rotary hydraulic motor (1-12) via the adjustment hydraulic cylinder (1-13); an output shaft of the main rotary hydraulic motor (1-12) is fixedly connected with the forward-backward moving component of the forward-backward telescopic device;

when the forward-backward moving component of the forward-backward telescopic device completely extends out, the distance from a front end of the drilling and bursting device (1) to a working plane is shorter than the distance from a front end of a cutting head of the cantilever type heading machine (2) to the working plane.

2. The drilling and bursting heading machine according to claim 1, characterized in that two sets of drilling and bursting devices (1), angle control devices and forward-backward telescopic devices are provided and symmetrically arranged on two sides of the rear of the cutting part of the cantilever type heading machine (2) and on a supporting plate (2-1) above the traveling part of the cantilever type heading machine (2).

3. The drilling and bursting heading machine according to claim 1 characterized in that the forward-backward telescopic device is of a gear-rack structure, a gear is arranged in the forward-backward moving component and driven by a hydraulic motor, and a rack is mounted on the cantilever type heading machine (2).

4. The drilling and bursting heading machine according to claim 3, characterized in that the forward-backward telescopic device is of a three-level telescopic structure, and comprises a lower forward-backward telescopic device, a middle forward-backward telescopic device and an upper forward-backward telescopic device;

the lower forward-backward telescopic device comprises a lower supporting rail (1-1), a lower guiding rack (1-2), a lower forward-backward moving component (1-3), a lower hydraulic drive motor (1-4) and a lower drive gear (1-5), wherein the lower supporting rail (1-1) is arranged in the forward-backward direction and fixedly mounted on the supporting plate (2-1), a limiting mechanism is arranged at each of two ends of the lower supporting rail (1-1), the lower guiding rack (1-2) is fixedly mounted on the lower supporting rail (1-1), the lower drive gear (1-5) is arranged in the lower forward-backward moving component (1-3) and coaxially connected with an output shaft of the lower hydraulic drive motor (1-4) mounted on the lower forward-backward moving component (1-3), the lower forward-backward moving component (1-3) is erected on the lower supporting rail (1-1) in a clamping fit manner, and the lower drive gear (1-5) is engaged with the lower guiding rack (1-2);

the middle forward-backward telescopic device comprises a middle supporting rail (1-8), a middle guiding rack (1-31), a middle forward-backward moving component (1-9), a middle hydraulic drive motor (1-10) and a middle drive gear (1-11), wherein the middle supporting rail (1-8) is arranged in the forward-backward direction and has a rear end mounted at a front end of the lower forward-backward moving component (1-3), a limiting mechanism is arranged at each of two ends of the middle supporting rail (1-8), the middle guiding rack (1-31) is fixedly mounted on the middle supporting rail (1-8), the middle drive gear (1-11) is arranged in the middle forward-backward moving component (1-9) and coaxially connected with an output shaft of the middle hydraulic drive motor (1-10) mounted on the middle forward-backward moving component (1-9), the middle forward-backward moving component (1-9) is erected on the middle supporting rail (1-8) in a clamping fit manner, and the middle drive gear (1-11) is engaged with the middle guiding rack (1-31); the output shaft of the main rotary hydraulic motor (1-12) is fixedly connected with the front of the middle forward-backward moving component (1-9);

the upper forward-backward telescopic device comprises an upper supporting rail (1-18), an upper guiding rack (1-19), an upper hydraulic drive motor (1-17) and an upper drive gear (1-16), wherein the upper supporting rail (1-18) is fixedly mounted on a lower end face of the fixing support (1-20), a limiting mechanism is arranged at each of two ends of the upper supporting rail (1-18), the upper guiding rack (1-19) is fixedly mounted on the upper supporting rail (1-18), the upper drive gear (1-16) is arranged in the mounting base (1-15) and coaxially connected with an output shaft of the upper hydraulic drive motor (1-17) mounted on the mounting base (1-15), the mounting base (1-15) is connected with the fixing support (1-20) via the upper supporting rail (1-18) clamped and matched with the mounting base (1-15), and the upper drive gear (1-16) is engaged with the upper guiding rack (1-19).

5. The drilling and bursting heading machine according to claim 4, characterized in that a rear end of the middle supporting rail (1-8) is articulated to an upper part of the front end of the lower forward-backward moving component (1-3), a pitch control hydraulic cylinder (1-7) articulated with the lower forward-backward moving component (1-3) is arranged at a lower part of the front end of the lower forward-backward moving component (1-3), and the other end of the pitch control hydraulic cylinder (1-7) is articulated with the bottom of the middle supporting rail (1-8).

6. The drilling and bursting heading machine according to claim 5, characterized in that one end of the pitch control hydraulic cylinder (1-7) and the rear end of the middle supporting rail (1-8) are respectively articulated to the lower part and upper part of the front end of the lower forward-backward moving component (1-3) via cross connectors (1-6), two pitch control hydraulic cylinders (1-7) are provided, the two pitch control hydraulic cylinders (1-7) are arranged side by side at the same horizontal position, a front end of the cross connector (1-6) is horizontally articulated with the pitch control hydraulic cylinder (1-7) or the rear end of the middle supporting rail (1-8), and a rear end of the cross connector (1-6) is vertically articulated with the front end of the lower forward-backward moving component (1-3); and the other ends of the two pitch control hydraulic cylinders (1-7) are respectively articulated side by side with the same horizontal position of the bottom of the middle supporting rail (1-8) via spherical hinges.

7. The drilling and bursting heading machine according to claim 1 characterized in that the telescopic drive mechanisms of the rock drill component and the bursting component of the drilling and bursting device (1) are of chain drive structures, the telescopic drive mechanism of the rock drill component comprises a chain drive assembly I (1-23) and a rock drill moving drive hydraulic motor (1-25), and the telescopic drive mechanism of the bursting component comprises a chain drive assembly II (1-29) and a bursting device moving drive hydraulic motor (1-28); both the chain drive assembly I (1-23) and the chain drive assembly II (1-29) comprise a closed drive chain and a chain wheel, the closed drive chain of the chain drive assembly I (1-23) is erected on the slide rail I (1-22-1) via the chain wheel and fixedly connected with the slide block I (1-24-3), the rock drill moving drive hydraulic motor (1-25) is mounted on the slide rail I (1-22-1), and an output shaft of the rock drill moving drive hydraulic motor (1-25) is coaxially connected with the chain wheel; the closed drive chain of the chain drive assembly II (1-29) is erected on the slide rail II (1-27-1) via the chain wheel and fixedly connected with the slide rail II (1-27-1), the bursting device moving drive hydraulic motor (1-28) is mounted on the slide rail II (1-27-1), and an output shaft of the bursting device moving drive hydraulic motor (1-28) is coaxially connected with the chain wheel.

8. The drilling and bursting heading machine according to claim 1 characterized in that the radius of gyration from the center of the drill rod (1-24-2) of the rock drill component to the center of the output shaft of the main rotary hydraulic motor (1-12) is matched with the radius of gyration from the center of the wedge jacking block of the bursting device (1-30-2) to the center of the output shaft of the main rotary hydraulic motor (1-12).

* * * * *